United States Patent [19]

Okamoto et al.

[11] Patent Number: 4,587,011

[45] Date of Patent: May 6, 1986

[54] THERMAL CRACKING PROCESS FOR SELECTIVELY PRODUCING PETROCHEMICAL PRODUCTS FROM HYDROCARBONS

[75] Inventors: Toshiro Okamoto, Tokyo; Michio Ohshima, Hiroshima, both of Japan

[73] Assignee: Mitsubishi Jukogyo Kabushiki Kaisha, Japan

[21] Appl. No.: 625,714

[22] Filed: Jun. 28, 1984

[30] Foreign Application Priority Data

Jun. 30, 1983 [JP] Japan ..... 58-119307

[51] Int. Cl.[4] ..... C10G 9/38

[52] U.S. Cl. ..... 208/129; 208/107; 208/130; 585/648; 585/652

[58] Field of Search ..... 208/130, 129, 128, 107; 585/648, 652

[56] References Cited

U.S. PATENT DOCUMENTS

| | | | |
|---|---|---|---|
| 4,136,015 | 1/1979 | Kamm et al. | 585/648 |
| 4,256,565 | 3/1981 | Friedman et al. | 585/652 |
| 4,264,435 | 4/1981 | Read, Jr. et al. | 585/652 |
| 4,321,131 | 3/1982 | Lowe | 585/648 |

*Primary Examiner*—John Doll
*Assistant Examiner*—Anthony McFarlane
*Attorney, Agent, or Firm*—Toren, McGeady, Stanger, Goldberg & Kiel

[57] ABSTRACT

A thermal cracking process for selectively producing petrochemical products from hydrocarbons which comprises the steps of: burning hydrocarbons with oxygen in the presence of steam to produce a hot gas of from 1300° to 3000° C. comprising steam; feeding hydrogen to the hot gas; further feeding starting hydrocarbons to the hot gas comprising the steam and hydrogen so that the starting hydrocarbons containing hydrocarbon components of higher boiling points are, respectively, fed to higher temperature zones so as to thermally crack the respective hydrocarbons under different conditions while keeping the cracking temperature at 650° to 1500° C., the total residence time at 5 to 1000 milliseconds, the pressure at 2 to 100 bars, and the partial pressure of hydrogen, after thermal cracking of a hydrocarbon comprising hydrocarbon components whose boiling point exceeds 200° C., at least 0.1 bar; and quenching the resulting reaction product.

4 Claims, 2 Drawing Figures

THERMAL CRACKING PROCESS FOR SELECTIVELY PRODUCING PETROCHEMICAL PRODUCTS FROM HYDROCARBONS

BACKGROUND OF THE INVENTION

1. Field of the Invention

This invention relates to a process for producing petrochemical products such as olefins, aromatic hydrocarbons (hereinafter abbreviated as BTX), synthetic gas (for methanol, and $C_1$ chemistry) and the like by thermal cracking of hydrocarbons. More particularly, it relates to a process for producing petrochemical products in high yield and high selectivity which comprises the steps of burning hydrocarbons with oxygen in the presence of steam to generate a hot gas comprising steam for use as a heat source for thermal cracking, feeding hydrogen to the hot gas comprising steam, and further feeding to the hot gas comprising the hydrogen and steam, hydrocarbons in such a way that hydrocarbons comprising higher boiling point hydrocarbon components are fed to and cracked at higher temperature zones.

2. Description of the Prior Art

As is well known, the tube-type thermal cracking process called steam cracking has heretofore been used to convert, into olefins, light gaseous hydrocarbons such as ethane and propane as well as liquid hydrocarbons such as naphtha and kerosine. According to this process, heat necessary for the reaction is supplied from outside through tube walls, thus placing limits on the heat transmission speed and the reaction temperature. Ordinary conditions adopted for the process include a temperature below 850° C. and a residence time ranging from 0.1 to 0.5 second. Another process has been proposed in which use is made of small-diameter tubes so that the cracking severity is increased in order to effect the cracking within a short residence time. In this process, however, because of the small inner diameter, the effective inner diameter is reduced within a short period of time owing to coking on the inner walls. As a consequence, the pressure loss in the reaction tubes increases with an increasing partial pressure of hydrocarbons, thus worsening the selectivity to ethylene. This, in turn, requires short time intervals of decoking, leading to the vital disadvantage that because of the lowering in working ratio of the cracking furnace and the increase of heat cycle due to the decoking, the apparatus is apt to damage. Even if the super high temperature and short time cracking would become possible, it would be difficult to stop the reaction, by quenching, within a short time corresponding to the cracking severity. This would result in the fact that the selectivity to ethylene which has once been established in a reactor unit considerably lowers by shortage of the quenching capability of a quencher.

In view of these limitations on the apparatus and reaction conditions, starting materials usable in the above process will be limited to at most gas oils. Application to heavy hydrocarbons such as residues cannot be expected. This is because high temperature and long time reactions involve side reactions of polycondensation with coking occurring vigorously and a desired gasification rate (ratio by weight of a value obtained by subtracting an amount of $C_5$ and heavier hydrocarbons except for BTX from an amount of hydrocarbons fed to a reaction zone, to an amount of starting hydrocarbon feed) cannot be achieved. Consequently, the yield of useful components lowers. Once a starting material is selected, specific cracking conditions and a specific type of apparatus are essentially required for the single starting material and a product derived therefrom. This is disadvantageously difficult in a free choice of starting material and product.

For instance, a currently used typical tube-type cracking furnace for naphtha has for its primary aim the production of ethylene. Thus, it is difficult to arbitrarily vary yields of other fundamental chemical products such as propylene, $C_4$ fractions and BTX in accordance with a demand and supply balance. This means that since it is intended to secure the production of ethylene from naphtha as will otherwise be achieved in high yield by high severity cracking of other substitute materials (e.g. heavy hydrocarbons), great potentialities of naphtha itself for formation of propylene, $C_4$ fractions such as butadiene, and BTX products are sacrificed. The thermal cracking reaction has usually such a balance sheet that an increase in yield of ethylene results in an inevitable reduction in yield of propylene and $C_4$ fractions.

Several processes have been proposed in order to mitigate the limitations on both starting materials and products. In one such process, liquid hydrocarbons such as crude oil are used as a fuel and burnt to give a hot gas. The hot gas is used to thermally crack hydrocarbons under a pressure of from 5 to 70 bars at a reaction temperature of from 1,315° to 1,375° C. for a residence time of from 3 to 10 milliseconds. In the process, an inert gas such as $CO_2$ or $N_2$ is fed in the form of a film from the burning zone of the hot gas toward the reaction zone so as to suppress coking and make it possible to crack heavy oils such as residual oils.

Another process comprises the steps of partially burning hydrogen to give a hot hydrogen gas, and thermally cracking various hydrocarbons such as heavy oils in an atmosphere of hydrogen under conditions of a reaction temperature of from 800° to 1800° C., a residence time of from 1 to 10 milliseconds and a pressure of from 7 to 70 bars thereby producing olefins. In this process, the thermal cracking is carried out in an atmosphere of great excess hydrogen, enabling one to heat and crack hydrocarbons rapidly within a super-short residence time while suppressing coking with the possibility of thermally cracking even heavy oils. However, power consumptions for recycle and separation of hydrogen, makeup, and pre-heating energy place an excessive economical burden on the process.

These processes all require very severe reaction conditions in order to obtain olefins in high yield from heavy hydrocarbons. As a result, olefinic products obtained are much inclined toward $C_2$ products such as ethylene, acetylene and the like, with an attendant problem that it is difficult to operate the processes such that propylene, $C_4$ fractions, and BTX are obtained at the same time in high yields.

A further process comprises separating a reactor into two sections, feeding a paraffinic hydrocarbon of a relatively small molecular weight to an upstream higher temperature section so that it is thermally cracked at a relatively high severity, e.g. a cracking temperature exceeding 815° C. and a residence time of from 20 to 150 milliseconds, thereby improving the selectivity to ethylene, and subsequently feeding gas oil fractions to a downstream low temperature section so as to thermally crack them at a low severity for a long residence time, e.g. a cracking temperature below 815° C. and a residence time of from 150 to 2,000 milliseconds whereby coking is suppressed. Instead, the gasification rate is sacrificed. Similar to the high temperature section, the purposes at the low temperature side are to improve the selectivity to ethylene.

In the above process, the starting materials are so selected as to improve the selectivity to ethylene: paraffinic materials which are relatively easy to crack are fed to the high temperature zone and starting materials abundant with aromatic materials which are relatively difficult to crack are fed to the low temperature zone.

However, starting materials containing aromatic components are cracked in the low temperature reaction zone at a low severity, so that components which can be evaluated as valuable products when gasified are utilized only as fuel. Thus, this process is designed to place limitations on the types of starting materials and products, thus presenting the problem that free selection of starting materials and production of intended products are not possible.

We made intensive studies to develop a thermal cracking process of hydrocarbons to selectively obtain desired types of olefins and BTX in high yields from a wide variety of hydrocarbons ranging from light to heavy hydrocarbons in one reactor while suppressing the coking. As a result, it was found that thermal cracking of hydrocarbons effectively proceeds by a procedure which comprises the steps of burning hydrocarbons with oxygen in the presence of steam to produce a hot gas stream containing steam, to which hydrogen is added, and feeding arbitrary starting hydrocarbons to different cracking positions in consideration of the selectivity to desired products and the characteristics of the respective starting hydrocarbons. By the thermal cracking, a variety of hydrocarbons ranging from gas oils such as light gas and naphtha to heavy oils such as asphalt can be treated simultaneously in one reactor. Moreover, olefins and BTX can be produced in higher yields and higher selectivities than in the case where individual hydrocarbons are thermally cracked singly as in a conventional manner. The present invention is acomplished based on the above finding.

SUMMARY OF THE INVENTION

It is accordingly an object of the invention to provide a thermal cracking process for selectively producing petrochemical products such as olefins, BTX and synthetic gas in high yields and high selectivities in one reactor while suppressing coking.

It is another object of the invention to provide a thermally cracking process in which the petrochemical products are obtained from a wide variety of starting hydrocarbons including light and heavy hydrocarbons by cracking different types of starting hydrocarbons under different cracking conditions in a hot gas atmosphere comprising steam and hydrogen.

The above objects can be achieved, according to the invention, by a thermal cracking process for selectively producing petrochemical products from hydrocarbons, the process comprising the steps of: (a) burning hydrocarbons with oxygen in the presence of steam to produce a hot gas of from 1300° to 3000° C. comprising steam; (b) feeding hydrogen to the hot gas; (c) further feeding starting hydrocarbons to the hot gas comprising the steam and hydrogen so that the starting hydrocarbons containing hydrocarbon components of higher boiling points are, respectively, fed to higher temperature zones so as to thermally crack the respective hydrocarbons under different conditions while keeping the cracking temperature at 650° to 1500° C., the total residence time at 5 to 1000 milliseconds, the pressure at 2 to 100 bars, and the partial pressure of hydrogen, after thermal cracking of a hydrocarbon comprising hydrocarbon components whose boiling point exceeds 200° C., at at least 0.1 bar; and quenching the resulting reaction product.

DETAILED DESCRIPTION AND EMBODIMENTS OF THE INVENTION

Figure 1:
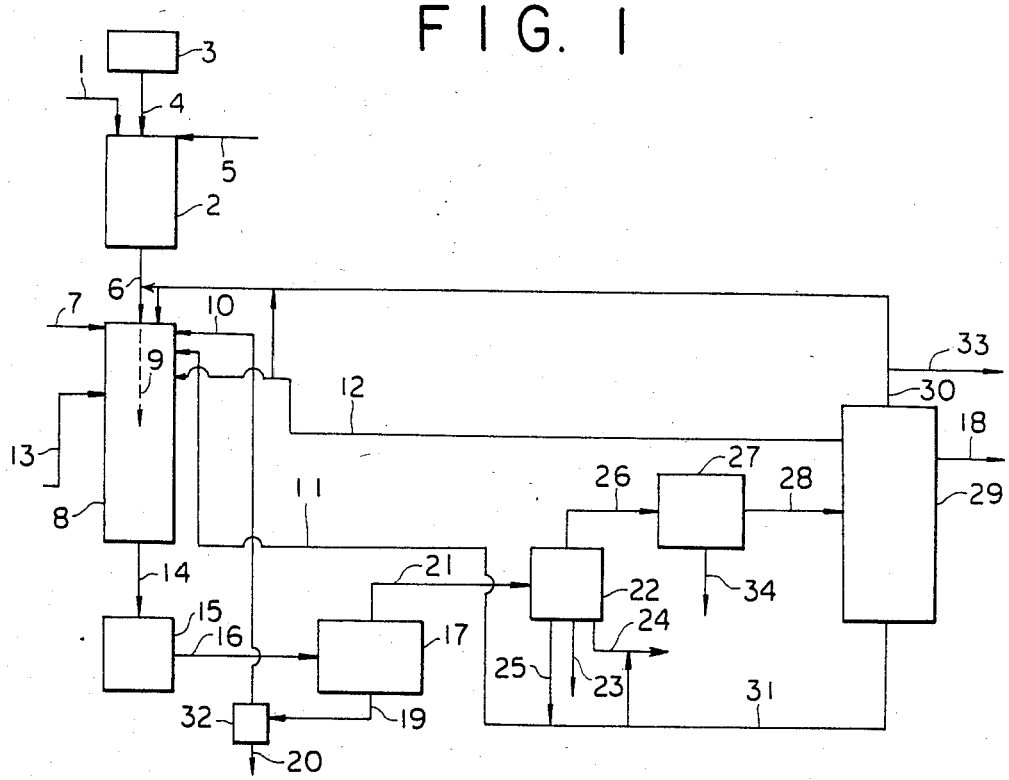
FIG. 1 is a flowchart of a process according to the invention.

According to the present invention, heat energy necessary for the thermal cracking reactions is supplied from a hot gas comprising steam which is obtained by burning hydrocarbons with oxygen in the presence of steam. The heat is supplied by internal combustion and such high temperatures as will not be achieved by external heat are readily obtained with the heat generated being utilized without a loss.

The heating by the internal combustion of hydrocarbons has been heretofore proposed. In general, hydrocarbons used as fuel for the above purposes are chiefly gaseous hydrocarbons and clean oils such as kerosine. Use of heavy oils as fuel has also been proposed. However, burning of these oils will cause coking and sooting, which requires circulation of an inert gas such as $CO_2$, $N_2$ or the like in large amounts as described before.

In the practice of the invention, burning is effected in the presence of a large amount of steam, including such steam as required in a downstream reaction zone, i.e. the amount is 1 to 20 times (by weight) as large as an amount of a fuel hydrocarbon. By this, coking and sooting can be suppressed by mitigation of the burning conditions and the effect of reforming solid carbon with steam. Accordingly, arbitrary hydrocarbons ranging from light gases such as methane and light hydrocarbons such as naphtha to heavy hydrocarbons such as cracked distillates and asphalt may be selected as the fuel. Alternatively, hydrogen and carbon monoxide may also be used as the fuel.

The amount of oxygen necessary for the burning may be either below or over the theroretical. However, if the amount of oxygen is too excessive, effective components and hydrogen for the reaction are unfavorably lost at a downstream position of a reactor. On the other hand, when the amount of oxygen is less than the theoretical, it is advantageous in that hydrogen and carbon monoxide are produced by partial burning and thus an amount of hydrogen being recycled to the reaction system can be reduced. The produced carbon monoxide can be readily converted to hydrogen by the shift reaction in a high temperature zone prior to or after the reaction zone or during the recycling process. Thus, the hydrogen consumed by the reaction can be made up by the converted hydrogen. The hydrogen and carbon monoxide generated by the partial burning both serve as a feed source of hydrogen which is important as a fundamental constituent of the invention.

By the supplement of the hydrogen, hydrogen relatively deficient in heavy hydrocarbons is made up, increasing the gasification rate and the yield of olefins with a remarkable improvement in control of selectivity to a desired product upon thermal cracking of arbitrary starting materials. Additionally, coking is advantageously further suppressed.

In some cases, the partial oxidation of fuel may be advantageous because synthetic gas useful for the manufacture of methanol or $C_1$ products is obtained as a main product or byproduct. In this case, the makeup or recycle of hydrogen for the reaction becomes unnecessary. This is particularly described in our Japanese Patent Application No. 041932/1983, which is incorporated herein by reference.

Different from $CO_2$, $N_2$ and other gases, steam added to the reaction system is readily condensed and recovered in a separation and purification procedure of the cracked gas, with an advantage that little or no additional burden is imposed on the purification system.

Oxygen necessary for the process of the invention is usually enriched oxygen which is obtained from air by low temperature gas separation, membrane separation or adsorption separation. If air is effectively used by combination with, for example, an ammonia production plant, such air may be used.

It is thermally advantageous that the hot gas from a burner (the combustion gas from the burner) is maintained at high temperatures while reducing the feed of steam from outside and is fed to a reactor as it is. However, when the temperature of the combustion gas exceeds 2400° C., a concentration of oxygen-containing radicals such as O, OH and the like increases, so that valuable products are lost considerably in a downstream reaction zone with an increase of acetylene, CO and the like in amounts. This makes it difficult to uniformly heat starting materials. In view of the stability of the burner construction, the gas temperature has a certain upper limit.

The invention is characterized by feeding hydrogen to the hot gas of 1300° to 3000° C. comprising steam which is produced in the burner and thermally cracking initially a high boiling hydrocarbon in the presence of the hydrogen and steam.

In the thermal cracking of the high boiling heavy hydrocarbon, it is important that the starting hydrocarbon be rapidly heated and evaporated for gasification and thermally cracked in the gas phase diluted with steam into low molecular weight olefins such as ethylene, propylene, butadiene and the like. By this, it becomes possible to attain a high gasification rate and produce olefins, BTX and the like in high yields. In contrast, if a satisfactory high heating rate is not attained, polycondensation in liquid phase takes place, with the result that the gasification rate and the yields of olefins and BTX become very unsatisfactory. In the practice of the invention, hydrogen is further fed to a hot gas of from 1,300° to 3,000° C., preferably from 1,400° to 2,400° C., comprising steam. Subsequently, the hot gas comprising the steam and hydrogen is brought to direct contact with the high boiling hydrocarbon. This direct contact enables one to achieve the rapid heating necessary for thermal cracking of the heavy hydrocarbon.

In practice, starting materials having higher boiling points and higher contents of polycyclic aromatic components such as asphaltene which are difficult to crack should be fundamentally fed to a higher temperature zone of the reactor in which hydrogen coexists. This permits accelerated thermal cracking of the heavy hydrocarbon, so that a high gasification rate and a high yield of olefins can be attained.

The existence of hydrogen in the thermal cracking atmosphere has the following great advantages.

Firstly, hydrogen has a thermal conductivity higher than other substances, so that even heavy hydrocarbons can be rapidly heated to a desired high temperature in an atmosphere comprising hydrogen. This is important in the thermal cracking of heavy hydrocarbons as described before.

Secondly, the polycondensation reaction in the liquid phase as described above is suitably suppressed by the hydrogenation reaction. With heavy hydrocarbons, hydrogen is deficient relative to the high content of carbon atoms in the heavy hydrocarbon. The gasification of heavy hydrocarbons is promoted by making up hydrogen from outside, resulting in an increased amount of light gases. With regard to formation of coke from the gas phase, it is possible to reduce an amount of acetylene which is a precursor necessary for the coking reaction.

Thirdly, hydrogen has the effect of increasing a concentration of radicals in the reaction system, leading to a high cracking speed and a high gasification rate.

The above three effects of hydrogen are more pronounced at higher temperatures under a higher partial pressure of hydrogen. Hence, use of hydrogen in the reaction atmosphere leads to a high gasification rate and a high yield of olefins synergistically with the condition where the heaviest hydrocarbon is thermally cracked in a reaction zone of the highest temperature.

The thermal cracking of heavy hydrocarbons is an endothermic reaction. The temperature of the reaction fluid after the thermal cracking slightly lowers but is still maintained at a high level. Especially, as compared with the case where hydrogen is absent, a lowering of the temperature is fairly small because of the heat generation caused by the hydrogenation. According to the invention, while the reaction fluid is successively brought to direct contact with light hydrocarbons of lower boiling points, thermal cracking of heavy hydrocarbons is promoted. In this sense, the initially applied heat energy is thus effectively utilized or recovered and the reaction product obtained from a heavier hydrocarbon can be rapidly quenched by the thermal cracking endothermic reaction of a lighter hydrocarbon.

In this manner, a light hydrocarbon with a lower boiling point is thermally cracked at a lower temperature under a lower partial pressure of hydrogen. It was found that a partial pressure of hydrogen after the cracking of hydrocarbons (including recycled cracked oils) containing hydrocarbon components whose boiling point exceeds 200° C. is essentially at least 0.1 bar in order to produce the effects of hydrogen described before and to attain a high gasification rate and a high yield of olefins.

As described before, the thermal cracking of heavy hydrocarbons is carried out under high severity in order to attain a high gasification rate and a high yield of olefins. As a result, the distribution of yield has such a feature that the content of ethylene among various olefins is high. In the process of the invention, relatively light hydrocarbons which are subsequently fed to and thermally cracked in a downstream low temperature zone are treated under an appropriate control of the range of boiling point (the type of hydrocarbon, e.g. naphtha fraction, kerosine fraction or the like), the amount, and/or the thermal cracking conditions. The distribution of yield of finally obtained, total olefins, BTX and the like can be arbitrarily controlled so that a final product has a desired composition. In other words, the selectivity to product can be arbitrarily controlled. In particular, the thermal cracking conditions are properly controlled depending on the feed position of starting material, the total pressure, the residence time and the temperature.

In order to optimize cracking conditions of the respective starting hydrocarbons from the standpoint of the flexible selection of starting hydrocarbons and products therefrom, steam, water, hydrogen, methane, hydrogen sulfide and the like may be fed at a position between feed positions of the respective starting hydrocarbons or simultaneously with the charge of starting hydrocarbons (in which case coking is suppressed during the course of feed of the starting hydrocarbons). As mentioned, this is also advantageous in suppressing coking. A similar procedure may be taken in order to offset the disadvantage produced by a partial load operation.

High boiling heavy hydrocarbons used in the practice of the invention include, for example, hydrocarbons comprising large amounts of polycyclic aromatic components such as asphaltene which have boiling points not lower than 350° C. and which are difficult to crack, e.g. topped crudes, vacuum residues, heavy oils, shale oil, Orinoko tar, coal liquefied oil, cracked distillates, cracked residues and petroleum pitches; and substances substantially free of asphaltene but containing large amounts of resins and aromatic compounds, e.g. vacuum gas oils, solvent-deasphalted oils, other heavy crude oils, and coal. On the other hand, the low boiling light hydrocarbons whose boiling points are not higher than 350° C. include, for example, various cracked oils and reformed oils such as LPG, light naphtha, naphtha, kerosine, gas oil, cracked gasolines ($C_5$ and higher fractions up to 200° C. but excluding BTX therefrom). As will be described hereinafter, light paraffin gases such as methane, ethane, propane and the like are different in cracking mechanism and are thermally cracked under different operating conditions.

The above classification depending on the boiling point or cracking characteristics is merely described as a basic principle. For instance, even though starting hydrocarbons contain such hydrocarbons having boiling points not lower than 350° C., those hydrocarbons such as light crude oil which contain substantial amounts of light fractions, abound in paraffinic components relatively easy in cracking, and which have a small amount of asphaltene are handled as light hydrocarbons. Likewise, starting hydrocarbons which contain hydrocarbon components having boiling points over 350° C. but consist predominantly of hydrocarbons having substantially such cracking characteristics as of hydrocarbons whose boiling point is below 350° C., are handled as light hydrocarbons whose boiling point is below 350° C.

If fuel oil is essential in view of the fuel balance in the system or other specific conditions exist, even hydrocarbons having boiling points over 350° C. may be thermally cracked under conditions similar to those for light hydrocarbons whose boiling point is below 350° C. in order to intentionally suppress the gasification rate.

In the event that a starting hydrocarbon contains hydrocarbon components whose boiling point is below 350° C. but relatively large amounts of hard-to-crack components such as resins, cracking conditions for high boiling hydrocarbons may be adopted in view of the requirement for selectivity to a desired product. In practice, similar types of starting materials which have a slight difference in boiling point are favorably fed from the same position so that the same cracking conditions are applied. As the case may be, starting materials of the same cracking characteristics may be thermally cracked under different conditions in order to satisfy limitations on the starting materials and requirements for final product.

As a principle, it is favorable that a hydrocarbon is thermally cracked under optimum cracking conditions which are determined on the basis of the cracking characteristics of the hydrocarbon. However, in view of limitations on starting hydrocarbons and requirements in composition of a final product, optimum cracking conditions may not always be applied.

In accordance with the process of the invention, starting hydrocarbons are fed to a multistage reactor and thus the above requirements can be satisfied without any difficulty.

The cracking characteristics of a starting hydrocarbon are chiefly judged from the boiling point thereof. More particularly and, in fact, preferably, the feed position and cracking conditions should be determined in view of contents of paraffins, aromatic compounds, asphaltene and the like substances in the individual starting hydrocarbons.

Needless to say, even though a hydrocarbon containing components whose boiling points are not lower than 350° C. cannot be utilized as a starting hydrocarbon, naphtha may be, for example, thermally cracked under high temperature and short residence time conditions as described with reference to high boiling heavy hydrocarbons in order to carry out the thermal cracking at high selectivity to ethylene. In a subsequent or downstream reaction zone, naphtha, propane or the like is fed and cracked under mild conditions so that selectivities to propylene, $C_4$ fractions and BTX are increased. Thus, a desired composition of the product can be arbitrarily obtained as a total system.

A further feature of the invention resides in that the light paraffin gases such as ethane, propane and the like, and the cracked oil produced by the thermal cracking are fed to positions of the reactor which are, respectively, determined according to the cracking characteristics thereof so as to attain a high gasification level (e.g. 65% or more in case of asphalt and 95% or more in case of naphtha).

The recycling of the cracked oil to the same reactor has been proposed in some instances, in which the cracked oil is merely fed to the same position and cracked under the same conditions as starting hydrocarbons. Little contribution to an improvement of yield can be expected. This is because when the cracked oil is fed at the same position as a fresh starting material, the starting material which is more likely to crack is preferentially cracked. The cracked oil merely suffers a heat history and is converted to heavy hydrocarbons by polycondensation reaction. In contrast, according to the invention, the cracked oil is recycled to a higher temperature zone than the position where a starting virgin hydrocarbon is being fed, by which the cracked oil is further cracked at a higher severity than the initial starting hydrocarbon from which the cracked oil is produced. In this manner, the cracked oil recycled to the reactor can be re-utilized as a starting material.

The feed position of the cracked oil is determined depending on the cracking characteristics and the desired composition of a final product. Especially, in order to increase selectivities to propylene, $C_4$ components and BTX, relatively mild cracking conditions of light hydrocarbons are used in the downstream reaction zone. As a consequence, the yield of the cracked oil increases while lowering a gasification rate. However, when this cracked oil is fed to a higher temperature zone upstream of the feed position of the initial starting hydrocarbon from which the cracked oil is mainly produced, it is readily cracked and converted into ethylene, BTX and the like. As a whole, the gasification rate and the total yield of useful components increase. At the same time, high selectivity to a desired product is ensured.

In known naphtha cracking processes, 15 to 20% of cracked oil (exclusive of BTX) is produced. In the practice of the invention, 70 to 80% of the cracked oil ordinarily used as fuel is recovered as useful components (ethylene, BTX and the like).

Light paraffinic gases such as ethane, propane and the like are fed to a reaction zone of a temperature from 850° to 1,000° C. and cracked to obtain ethylene, propylene and the like in high yields. When heavy hydrocarbons are simultaneously cracked at a high severity, these gases serving also as a hydrogen carrier gas may be fed to a position upstream of or to the same position as the feed position of the heavy hydrocarbon.

On the other hand, hydrogen (and methane) may be fed to the reaction zone, according to the principle of the present invention, along with the hydrogen and carbon monoxide produced by the partial combustion unless the synthetic gas is not required. Alternatively, it may be fed to a position same as or upstream of the feed position of a starting hydrocarbon predominantly composed of hydrocarbon components having boiling points not lower than 350° C. in order to supplement hydrogen deficient in the heavy hydrocarbon and convert to useful components.

Moreover, when a light hydrocarbon such as naphtha having a high content of hydrogen is fed to a downstream zone of the reactor, a partial pressure of hydrogen increases at the zone. As a result, the thermally cracked oil, cracked residue and the like which contain large amounts of the radicals produced by the cracking of the heavy hydrocarbon in the upstream zone of the reactor are hydrogenated and thus stabilized. Thus, formation of sludge, and coking in the reactor and the quenching heat exchanger are suppressed with the thermally cracked residue being stabilized.

However, the stabilization of the thermally cracked residue only by the action of the hydrogen may be, in some case, unsatisfactory depending on the type of starting hydrocarbon and the cracking conditions. In such case, the residue may be separately treated with hydrogen. According to the invention, the residue is stabilized by additional feeding of hydrogen from the required optimum position and recycling of hydrogen and methane from the product separation and purification system via a bypass to a desired position.

A carbonaceous cracked residue which is produced by cracking of a heavy hydrocarbon alone under a super severity was hard or impossible to handle (or transport) for use as a starting material or fuel or to atomize in burners. However, these problems of the handling and the atomization in burners are readily solved, according to the invention, due to the fact that the thermal cracking is effected in an atmosphere of hydrogen and the cracked oil obtained by mild cracking of a light hydrocarbon at a downstream low temperature side is mixed with the carbonaceous cracked residue obtained by thermal cracking at an upstream high temperature side. That is, the cracked oil from the light hydrocarbon abounds in volatile matters and hydrogen-yielding substances, so that the solid cracked residue is stably converted to a slurry by mixing with the oil. In addition, an increase of the volatile matters makes it easier to boil and spray the mixture in burners, thus facilitating atomization to allow the cracked residue to be re-utilized as a starting material for conversion into useful components.

The present invention have further advantages and characteristic features described below.

As described before, the feed of a light hydrocarbon comprising low boiling hydrocarbon components which have boiling points below 350° C. and are more likely to crack contributes to more effectively recover heat energy used to thermally crack a heavier hydrocarbon by absorption of heat required for the reaction of the light hydrocarbon. Because the reaction fluid, from the high temperature upstream side, comprising a cracked gas from the heavy hydrocarbon is rapidly cooled by the endothermic reaction of the light hydrocarbon, a loss of valuable products by excessive cracking can be avoided.

In the practice of the invention, the thermal cracking of hydrocarbons is effected by making the best use of the heat energy supplied for the cracking, and thus a consumption of fuel gas per unit amount of product can be markedly reduced, with the advantage that the power consumption required for the separation and purification of the cracked gas can be much more reduced than in known similar techniques. In other words, the utility including fuel, oxygen and the like per unit product considerably lowers.

Once again, the present invention is characterized in that light and heavy hydrocarbons having significant differences in cracking characteristics are, respectively, cracked under optimum conditions required for the respective cracking characteristics in view of the desired type of product. High boiling heavy hydrocarbons such as topped crudes, vacuum residues and the like undergo polycondensation reaction in liquid phase competitively with the formation reaction of olefins. In order to increase the gasification rate and the yield of olefins, it is necessary to reduce the residence time in liquid phase as small as possible and to supplement to the reaction system hydrogen which is relatively deficient in the system. In this sense, it is very important to effect the cracking under high temperature and super-short time conditions in the presence of hydrogen. However, when cracked at such high temperatures, once formed propylene and $C_4$ components will be further cracked into ethylene irrespective of the short residence time. Thus, the ratio of ethylene in the final product becomes very high. On the contrary, if it is intended to increase selectivities to propylene and $C_4$ components, the gasification rate lowers. Although propylene and $C_4$ components slightly increase in amounts, the yield of ethylene lowers considerably. Judging from the above, heavy hydrocarbons should preferably be cracked under conditions which permit an increase in selectivity mainly to ethylene.

On the other hand, light hydrocarbons such as naphtha are readily gasified, and either polycondensation of acetylene, ethylene or butadiene in gas phase or cyclization dehydrogenation reaction of starting paraffins gives BTX and cracked oil. As compared with heavy hydrocarbons, the influence of the heating velocity is smaller and a relatively wider range of reaction conditions may be used. For instance, high temperature cracking permits predominant formation of lower olefins by cracking of the paraffin chains. The yield of BTX and cracked oil by the cyclization dehydrogenation reaction lowers. BTX formed by polycondensation of lower olefins and acetylene in gas phase increases with an increase of the residence time. At short residence time, the yield of BTX lowers. The content of propylene and $C_4$ components in the lower olefins lowers at a high severity (i.e. under higher temperature and longer residence time conditions) because, under such conditions, they tend to be cracked into ethylene with an increase in selectivity to ethylene.

With light hydrocarbons, a high gasification rate may be obtained by cracking even at low temperatures, which is different from the case of heavy hydrocarbons. In addition, the product comprises an increasing ratio of propylene and $C_4$ fractions with less valuable methane which is formed by cracking of the above olefins being reduced in amounts. The total yield of valuable olefins including $C_2$ to $C_4$ increases to the contrary. The hydrogen existing in the reaction system accelerates conversion of propylene and the like into ethylene at such high temperatures as will be experienced under cracking conditions of heavy hydrocarbons. However, under mild reaction conditions of relatively low temperatures, the accelerating effect of hydrogen considerably lowers. In the cracking at low temperatures, the relative yield of BTX and the cracked oil produced by the cyclization dehydrogenation reaction increases. The increase in yield of the cracked oil may bring about a lowering of the gasification rate when the cracked oil is left as it is. In the practice of the invention, the cracked oil is fed to a position of temperature higher than the temperature at which the cracked oil is formed, by which it is converted into ethylene, BTX and the like. As a whole, the gasification rate, and the yield of and selectivity to useful components can be improved over ordinary cases of single stage cracking at high temperatures.

In the process of the invention, light hydrocarbons and heavy hydrocarbons having different cracking characteristics are cracked under different conditions: a heavy hydrocarbon is cracked under high temperature and high severity conditions in the presence of hot steam and hydrogen so as to attain a high gasification rate and a high yield of olefins (mainly composed of ethylene). Subsequently, a light hydrocarbon is cracked under low temperature and long residence time conditions in order to achieve high selectivity to $C_3$ and $C_4$ olefins and BTX, thereby preparing a controlled composition of product. The cracking conditions under which high selectivity to $C_3$ and $C_4$ olefins and BTX is achieved are relatively low temperature conditions as described before. The excess of heat energy which is thrown into the reactor for thermal cracking of heavy hydrocarbons is effectively utilized for the low temperature cracking. Moreover, the cracked oil produced by cracking of starting hydrocarbons is further cracked under higher temperature conditions than in the case of the starting hydrocarbon. In this manner, the component which has been hitherto evaluated only as fuel can be converted into valuable BTX components and ethylene. For instance, condensed aromatic ring-bearing substances such as anthracene are cracked at high temperatures for conversion into highly valuable components such as methane, ethylene, BTX and the like. This conversion is more pronounced at a higher partial pressure of hydrogen.

In the practice of the invention, in order to effectively utilize starting hydrocarbons, the starting hydrocarbons are fed to different positions of a multi-stage reactor depending on the cracking characteristics. In the high temperature stage or zone, cracking under high severity conditions is effected to achieve a high gasification rate and a high yield of ethylene. In a subsequent zone, a hydrocarbon is cracked so that high selectivity to $C_3$ and $C_4$ fractions and BTX is achieved. Thus, there are prepared the cracked gas which is obtained under high severity cracking conditions in the high temperature zone and is predominantly made of ethylene, and the cracked gas obtained in the low temperature zone and having high contents of $C_3$ and $C_4$ olefins and BTX, making it possible to selectively produce a product of a desired composition as a whole. As described before, it is not necessarily required that a heavy hydrocarbon having a boiling point not lower than 350° C. be used as a starting virgin material. For instance, naphtha or kerosine may be cracked at high temperatures in the upstream zone, thereby giving a cracked gas enriched with ethylene. In the downstream zone, hydrocarbons which have the high potentiality of conversion into $C_3$ and $C_4$ olefins such as LPG, naphtha and the like, and BTX are thermally cracked under conditions permitting high selectivity to the $C_3$, $C_4$ olefins and BTX, thereby obtaining a controlled composition. According to the present invention, one starting material such as naphtha may be divided into halves which are, respectively, subjected to the high temperature and the low temperature crackings. Alternatively, all of virgin naphtha may be cracked at low temperatures, followed by subjecting the resulting cracked oil to the high temperature cracking so as to meet the purposes of the invention. These procedures are very favorable. On the contrary, with heavy hydrocarbons such as vacuum gas oil made of components with boiling points over 350° C. and having high selectivity to $C_3$, $C_4$ olefins and BTX, cracking of the heavy hydrocarbon at high and low temperature zones is within the scope of the present invention.

The manner of application as described above may be suitably determined depending on the availability of starting hydrocarbon and the composition of final product based on the trend of demand and supply. In particular, cracking of heavy hydrocarbons involved the problem that in order to attain a high gasification rate, high temperature or high heat energy is needed and that a composition of product is much inclined toward ethylene, thus being short of flexibility of the product. The practice of the present invention ensures a lowering of heat energy per unit product and a diversity of components obtained as products. Various heavy hydrocarbons can be effectively utilized as starting materials.

The process of the invention is described in detail by way of an embodiment.

Reference is now made to the accompanying drawings and particularly to FIG. 1 which shows one embodiment of the invention where the industrial application of the process of the invention is illustrated but should not be construed as limiting the present invention thereto.

In FIG. 1, a fuel hydrocarbon 1 is pressurized to a predetermined level and fed to a burning zone 2. To the burning zone 2 is fed oxygen 4 from an oxygen generator 3, followed by partially burning the fuel hydrocarbon 1 in the presence of preheated steam fed from line 5 to give a hot combustion gas stream 6 of from 1,300° to 3,000° C. The steam may be fed singly or in the form of a mixture with the oxygen 4 and the fuel 1, or may be fed along walls of the burning zone 2 in order to protect the walls and suppress coking. The hot combustion gas stream 6 which is charged from the burning zone 2 and comprises hydrogen and steam is passed into a reaction zone 8 after mixing with hydrogen fed from line 30. To the reaction zone 8 is first fed a heavy virgin hydrocarbon 7, e.g. asphalt, chiefly composed of hydrocarbon components with boiling points not lower than 350° C. in which it directly contacts and mixes with the hot combustion gas stream 6, and is rapidly heated and cracked. As a result, there is produced a hot reaction fluid 9 comprising a major proportion of olefins, particularly ethylene. Subsequently, the hot reaction fluid 9 is brought to contact with a high boiling cracked oil (boiling point: 200° to 530° C.) 10, cracked gasoline 11 ($C_5$—200° C.), a light paraffin gas 12 including ethane, propane, butane and the like, and a light virgin hydrocarbon 13 having a boiling point not higher than 350° C., which are successively fed to the reaction zone 8 in which there are thermally cracked. At the same time, the hot reaction fluid 9 is gradually cooled and the heat energy initially thrown into the burning zone 2 is utilized as the heat of reaction for thermally cracking the subsequently fed hydrocarbons. Next, the reaction fluid 14 discharged from the reaction zone 8 is charged into a quencher 15 in which it is quenched and heat is recovered. The quencher 15 is, for example, an indirect quenching heat exchanger in which two fluids passed through inner and outer tubes are heat exchanged. The reaction fluid 16 discharged from the quencher 15 is then passed into a gasoline distillation tower 17 where it is separated into a mixture 21 of cracked gas and steam and a cracked residue 19 (200° C.+). The cracked oil 19 is further separated, in a distillation apparatus 32, into a high boiling cracked oil 10 and a fuel oil 20 (530° C.+). The high boiling cracked oil 10 is recycled downstream of the position where the heavy virgin hydrocarbon 7 is fed, and is again cracked. On the other hand, the fuel oil 20 is used as a heat source such as process steam, or as the fuel 1 fed to the burning zone 2. The mixture 21 of cracked gas and steam is passed into a high temperature separation system 22 where it is separated into cracked gas 26, process water 23, BTX 24, and cracked gasoline 25 obtained after separation of the BTX. The cracked gas 26 is further passed into an acid gas separator 27 in which $CO_2$ and $H_2S$ 34 are removed, followed by charging through line 28 into a production separation and purification apparatus 29. In the apparatus 29, the gas 26 is separated into hydrogen and methane 30, olefins 18 such as ethylene, propylene, butadiene and the like, light paraffin gases 12 such as ethane, propane, butane and the like, and $C_5$ and heavier components 31. Of these, the hydrogen and methane 30 may be withdrawn as 33 for the fuel 1. Alternatively, it may be mixed with the hot gas 6 comprising steam or fed to either the feed position of the heavy hydrocarbon 7 at an upper portion of the reaction zone 8 or an upper portion of the feed position for further cracking. The light paraffin gases 12 may be fed to a zone of an intermediate temperature ranging from 850° to 1000° C. in order to obtain ethylene, propylene and the like in high yields. Alternatively, they may be recycled by mixing with hydrogen and methane and further cracked in which the mixture has the function of yielding hydrogen to heavy hydrocarbons as well. The $C_5$ and heavier components 31 are recycled, after separation of the BTX 24, from line 11 to a position intermediate between the feed positions of the high boiling cracked oil 10 and the light hydrocarbon 13 along with the cracked gasoline 25 from the high temperature separation system 22 and is further cracked.

The fuel hydrocarbon 1 is not critically limited. Aside from the cracked residues, there can be used a wide variety of materials including light hydrocarbons such as light hydrocarbon gases, naphtha, kerosine and the like, heavy hydrocarbons such as topped oils, vacuum residues, heavy oils, shale oil, bitumen, coal-liquefied oil, coal, and the like, various cracked oils, non-hydrocarbons such as CO and $H_2$, and the like. These materials are properly used depending on the process and the availability. Fundamentally, materials which are relatively difficult in conversion into valuable products and are low in value are preferentially used as fuel.

Examples of the starting heavy hydrocarbon 7 which has boiling points not lower than 350° C. are petroleum hydrocarbons such as vacuum gas oils, topped crudes, vacuum residues and the like, shale oil, bitumen, coal-liquefied oil, coal and the like, but are not limited thereto. Examples of the light hydrocarbon 13 are LPG, naphtha, kerosine, gas oil, paraffinic crude oils, paraffinic topped crudes, and the like. Other hydrocarbons which have similar functions as those indicated above may likewise be used without limitations. The position where the cracked oil is recycled is finally determined in view of the type of starting virgin hydrocarbon, the properties of the cracked oil, and the composition of final product. For instance, when topped crude is used as the starting heavy hydrocarbon 7, it is preferable that the high boiling cracked oil 10 is fed at a position upstream of the heavy virgin hydrocarbon 7. On the other hand, when vacuum residue is used as the heavy hydrocarbon 7, it is preferable to feed the cracked oil at a position particularly shown in FIG. 1. The high boiling cracked oil may be further separated, for example, into a fraction of 200° to 350° C. and a fraction of 350° to 530° C., after which they are fed.

In FIG. 1, there is shown the embodiment in which there are used as starting materials a heavy hydrocarbon mainly composed of hydrocarbon components whose boiling points are not lower than 350° C. and a light hydrocarbon mainly composed of hydrocarbon components whose boiling points are not higher than 350° C. However, as described before, instead of using the heavy hydrocarbon comprising components having boiling points not lower than 350° C., there may be fed, for example, naphtha alone as the starting material. In the case, the feed line 7 of the heavy virgin hydrocarbon is not used with similar effects being obtained. Naphtha may be fed instead of the starting heavy hydrocarbon 7 and the cracked oil may be recycled to a position upstream of the feed position of the naphtha. Even when three or more starting materials including asphalt, light gas and naphtha are used, the process of the invention is feasible by feeding asphalt from the feed position of the heavy hydrocarbon 7 of FIG. 1, naphtha from the feed position of the light hydrocarbon 13, and the gas oil from the stage intermediate therebetween.

In the embodiment of FIG. 1, the makeup of hydrogen consumed by the partial combustion of the fuel 1 is balanced with the hydrogen 30 recycled from the separation and purification system in order to keep, but not consume, the partial pressure of hydrogen in the reaction system. The consumption of hydrogen in the entirety of the reaction system is determined depending on the H/C ratio (atomic ratio) of starting heavy and light hydrocarbons. In case where the H/C ratio in the starting materials is fairly high as a whole, makeup hydrogen obtained by the partial oxidation of fuel is not necessarily required. This is because when naphtha is used as the light hydrocarbon, its H/C ratio is relatively high, so that hydrogen is produced by the thermal cracking and thus a substantial amount of hydrogen deficient in the heavy hydrocarbon can be made up by the produced hydrogen depending on the conditions. For the makeup of hydrogen, it is favorable to resort to the partial oxidation of the fuel 1. Of course, hydrogen may be supplemented from a hydrogen generator based on ordinary hydrogen reforming.

As described in detail, the present invention has a number of features as will not be experienced in prior art techniques. More particularly, a hydrocarbon is burnt with oxygen in the presence of steam to supply a heat energy required for the reaction. To the resulting hot gas is fed hydrogen to obtain a gas comprising hydrogen and steam, to which are successively fed at least two kinds of starting hydrocarbons so that the starting hydrocarbons having high boiling points are successively fed and thermally cracked according to the boiling point. The above manner of thermal cracking has the following advantages and features.

(1) Arbitrary heavy hydrocarbons, arbitrary light hydrocarbons and cracked oils therefrom can be thermally cracked simultaneously in one reactor but under different conditions which are properly determined depending on the cracking characteristics of the individual starting materials and the selectivity to a desired product. As a result, there can be selectively obtained ethylene, propylene, $C_4$ fractions, BTX and synthetic gas (methanol, etc.) in arbitrary ratios while achieving high gasification rates, high yields and high heat efficiencies.

(2) In the thermal cracking of heavy hydrocarbons, it is necessary to crack them in the presence of hydrogen under very severe conditions of high temperature and short residence time in order to maximize the gasification rate. As a result, a high yield of olefins can be expected but a ratio of ethylene to the olefins increases. This leads to the problem that the selectivity to a desired product is low (little flexibility of product is left) and the energy cost per unit product increases. According to the invention, in order to much improve a selectivity to product, light hydrocarbons are thermally cracked under controlled cracking conditions in a downstream zone. This lads to a remarkable improvement in flexibility of a composition of product as a whole with a drastic reduction of the energy cost per unit product.

(3) Even produced cracked oils, cracked residues and byproduct gases are effectively utilized to full extent because they are fed to cracking stages different from a stage for a starting virgin material according to the cracking characteristics of the respective materials. As a result, the cracked oils and the like which are ordinarily utilized only as fuel can be converted into useful components such as BTX, olefins and the like. Thus, less valuable resources can be effectively and efficiently re-utilized as a starting material as will not be expected at all from known processes.

(4) The coexistence of hydrogen in the cracking atmosphere for heavy hydrocarbons is advantageous in that hydrogen which is deficient in heavy hydrocarbons and cracked oils is made up and olefins, BTX and the like are produced therefrom in high yields.

(5) The utility such as fuel, oxygen and the like per unit product is remarkably reduced, with the result that the consumption of combustion gas lowers considerably and thus the separation and purification cost for cracked gas can also be reduced noticeably.

(6) The cracked gases of heavy hydrocarbons are apt to undergo coking, and it is generally difficult to recover high pressure steam. On the contrary, according to the invention, the thermal cracking is effected in an atmosphere comprising hydrogen and there are produced hydrogen and methane by thermal cracking of light hydrocarbons. By the action of the hydrogen and methane, radicals produced by thermal cracking of heavy hydrocarbons or cracked oils in upstream zones are stabilized, suppressing formation of sludge, and coking in the reactor and the quenching heat exchanger. Synergistically with the dilution of coking substances with cracked gases from light hydrocarbons, heat recovery as high pressure steam in the quenching heat exchanger is possible even though heavy hydrocarbons such as asphalt are thermally cracked. Heat economy is remarkably improved.

(7) Upon cracking of light hydrocarbons which are ready for cracking, the hot cracked gas passed from an upstream zone is effectively quenched, preventing a loss of useful products as will be caused by excess cracking.

The present invention is described in more detail by way of examples, which should not be construed as limiting the present invention but for explanation only.

EXAMPLE 1

A vacuum residue (specific gravity 1.02, S content 4.3%, pour point 40° C.) from crude oil of the Middle East was used as fuel. The vacuum residue was charged into an ordinary combustor of the burner type located above a reactor where it was burnt with oxygen while blowing steam preheated to over 500° C. from all directions, thereby generating a hot gas comprising steam. At a position downstream of the combustor, hydrogen which was heated to about 500° C. were injected into a portion just above the reactor and mixed with the hot gas. The hot gas was introduced into the reactor provided beneath the combustor where it was uniformly mixed with a starting hydrocarbon which was fed from a plurality of burners mounted on the side walls of the reactor, thereby thermally cracking the starting hydrocarbon. Thereafter, the reaction product was indirectly cooled with water from outside, followed by analyzing the product to determine a composition thereof. On the side walls of the reactor were provided a number of nozzles along the direction of flow of the reaction fluid in order to set different cracking conditions for different types of starting hydrocarbons. By this, a test was made in which different types of starting hydrocarbons or cracked oils were fed to different positions of the reactor. In order to suitably control the reaction conditions, it was possible to fed hot steam from the nozzles as the case may be. The residence time was calculated from the capacity of the reactor and the reaction conditions.

Table 1 shows the results of the test concerning the relation between cracking conditions and yields of products in which the Middle East naphtha (boiling point 40°-180° C.) was cracked at a pressure of 10 bars.

In Table 1, Comparative Example 1 shows the results of mere thermal cracking of naphtha. Comparative Example 2 shows the results in which the cracked gasoline and the cracked residue produced in Comparative Example 1 were recycled to substantially the same position as the feed position of the starting naphtha and thermally cracked. On the other hand, in Example 1, the cracked residue, cracked gasoline and starting naphtha were fed to different feed positions in this order where they were cracked. The temperature at the outlet of the reactor was from 750° to 800° C. in Comparative Example 1 and Example 1. In Example 1, the cracked residue and the cracked gasoline were, respectively, further cracked at 1400° C. and 1350° C. In both cases, the residence time from the feed to the reactor till the feed of a next hydrocarbon was about 5 milliseconds. As will be clear from the results of Example 1, when the cracked residue and the cracked gasoline were cracked under severer conditions than the starting naphtha, a higher gasification rate and higher selectivities to $C_3$, $C_4$ and BTX are attained than in the case of Comparative Examples 1 and 2 while keeping a high yield of olefins. On the other hand, where the cracked residue and cracked gasoline are recycled merely to the position of the same cracking conditions as the starting naphtha (Comparative Example 2), the gasification rate and the yield of BTX slightly increased with an increasing amount of cracked residue. Thus, as compared with the high cracking rate in Example 1, the results of the Comparative Example was very unsatisfactory.

TABLE 1

| | Comparative Example 1 | Comparative Example 2 | Example 1 |
|---|---|---|---|
| Feed (kg/kg of starting naphtha) | | | |
| (1) fuel | 0.132 | 0.135 | 0.139 |
| (2) steam | 1.8 | 1.8 | 1.8 |
| (3) hydrogen | 0.031 | 0.032 | 0.032 |
| Pressure (bars) | 10 | 10 | 10 |
| Residence time (msec.) | 70 | 70 | 80 |
| Yields (wt % to starting naphtha) | | | |
| $CH_4$ | 21.0 | 22.5 | 21.2 |
| $C_2H_4$ | 35.9 | 35.6 | 34.2 |
| $C_2H_6$ | 6.4 | 6.2 | 6.2 |
| $C_3H_6$ | 11.7 | 11.9 | 13.5 |
| $C_4$'s | 3.9 | 4.1 | 6.7 |
| BTX | 11.0 | 13.2 | 15.5 |
| cracked gasoline*1 | 6.9 | 2.9 | 1.7 |
| cracked residue*2 | 3.7 | 4.1 | 1.2 |
| $C_2$ - $C_4$ olefins*4 | 56.9 | 56.9 | 59.7 |
| olefins + BTX | 67.9 | 70.1 | 75.2 |

Note
*1 $C_5$ - 200° C. fractions (exclusive of BTX)
*2 200° C. + fractions
*3 Additional steam in the reactor
*4 Ethane recycle is contained.

TABLE 2

| | Comparative Example 3 | Example 2 | Example 1 |
|---|---|---|---|
| Feed (kg/kg of starting vacuum residue) | | | |
| (1) fuel | 0.226 | 0.226 | 0.250 |
| (2) steam | 1.85 | 1.85 + 1.3*3 | 1.85 + 1.6*3 |
| (3) naphtha | — | 1.1 | 1.1 |
| (4) cracked gasoline | — | — | 0.298 |
| (5) high boiling cracked oil | — | — | 0.045 |
| (6) hydrogen | 0.127 | 0.127 | 0.127 |
| Pressure (bars) | 10 | 10 | 10 |
| Residence time (msec.) | 15 | 100 | 110 |
| Yields (wt % to starting vacuum residue) | | | |
| $CH_4$ | 35.1 | 48.2 | 50.8 |
| $C_2H_4$ | 15.8 | 51.1 | 54.9 |
| $C_2H_6$ | 11.3 | 18.2 | 18.0 |
| $C_3H_6$ | 0.6 | 18.2 | 18.0 |
| $C_4$'s | 0.4 | 11.2 | 11.5 |
| BTX | 8.0 | 20.5 | 26.8 |
| cracked gasoline*1 | 5.3 | 13.2 | 3.3 |
| cracked residue*2 | 25.2 | 29.8 | 27.8 |
| $C_2$ -$C_4$ olefins*4 | 26.4 | 96.0 | 99.7 |
| olefins + BTX | 34.4 | 116.5 | 126.5 |

EXAMPLE 2

Table II shows the results of tests in which a vacuum residue of the same type as used as fuel was provided as a heavy hydrocarbon and the naphtha used in Example 1 was used as a light hydrocarbon, and they were thermally cracked in the same apparatus as used in Example 1. Comparative Example 3 shows the results of a test in which the vacuum residue alone was thermally cracked at an initial temperature of 1150° C. At this time, the outlet temperature of the reactor was extremely high, so that water was directly injected into the reactor and quenched to measure a reaction product. In Example 2, naphtha was used instead of water and fed under cracking conditions close to those of Example 1. At the time, in order to control the partial pressure of hydrogen and temperature of the cracking atmosphere, 1.6 kg of hot steam was fed just before the feed of naphtha. In this manner, the hot gas after the thermal cracking of the vacuum residue was utilized to crack naphtha in an amount almost equal to the amount of the starting vacuum residue. As a result, the composition of a final product could be remarkably improved. On the other hand, where the vacuum residue alone was cracked at an initial temperature of 950° C., the gasification rate was about 45 wt% and thus considerably lowered as compared with the high temperature cracking of Comparative Example 3 in which the rate reached about 70%. From the above results, it will be seen that in order to obtain a high gasification rate from heavy hydrocarbons, it is preferable to crack them at high temperatures over 1000° C. This leads to the fact that the gas after the cracking of the heavy hydrocarbons are fairly high. In particular, when hydrogen is caused to exist beforehand in the reaction system, the hydrogenation reaction exothermically proceeds to contribute to the temperature rise. However, the hot gas can be utilized as a heat source by which light hydrocarbons such as naphtha can be readily cracked as shown in Example 2. This permits the yield of product relative to an amount of fuel to be much more improved over the case of Comparative Example 3. Example 3 shows a thermal cracking process in which the cracked residue produced in Example 2 was separated by distillation and a part of the fraction below 500° C. provided as a high boiling cracked oil was fed to a position corresponding to about 10 milliseconds after the feed of the starting vacuum residue, followed by feeding cracked gasoline to a position corresponding to about 5 milliseconds thereafter and further feeding virgin naphtha to a position corresponding to further about 5 milliseconds after the preceding feed. At this time, similar to Example 2, the same amount of steam was fed to a position just before the feed position of virgin naphtha in order to control the cracking conditions. The cracked residue from which the high boiling cracked oil was removed was used as fuel instead of the vacuum oil. The cracking temperature of the high boiling crcked oil was about 1250° and the cracking temperature of the cracked gasoline was about 1200° C. The partial pressure of hydrogen after the cracking of the vacuum residue was from about 1.5 to 2.0 bars. On the other hand, the reactor outlet temperature after the cracking of naphtha was about 800° C. When the cracked gasoline and the high boiling cracked oil were recycled, the yield of $C_3$ and $C_4$ components was maintained at a level with a further increase in yield of ethylene and BTX. From this, it will be seen that the recycled oils are effectively converted into useful components.

As described in detail above, the scope within which the present invention is effective is described as follows.

Hydrocarbons being fed to a reactor may be selected from a wide variety of hydrocarbons including light to heavy hydrocarbons and should be fed to a reactor of at least two stages. The feed positions of individual hydrocarbons are finally determined depending on the cracking characteristics of the individual hydrocarbons and the composition of a required product. Fundamentally, however, it is desirable that a hydrocarbon comprising hydrocarbon components having higher boiling points be fed to a higher temperature zone in which it is cracked. Moreover, a position where the cracked oil is to be recycled should involve at least severer conditions than the conditions for a starting virgin hydrocarbon from which the cracked oil is chiefly produced.

As for the reaction temperature, it should be borne in mind that as described above, heavier hydrocarbons are cracked under higher temperature conditions. Especially, where a heavy hydrocarbon comprising components whose boiling points not lower than 350° C. is used, it is preferably that an initial cracking temperature is over 1,000° C. When the initial cracking temperature lower than 1,000° C. is applied to such a heavy hydrocarbon, the gasification rate considerably lowers with an increase in amount of heavy cracked residue. Thus, the merit of the use of heavy hydrocarbons as starting materials is substantially lost. The temperature at the outlet of the reactor should preferably be over 650° C. Lower temperatures involve a considerable lowering of the speed of cracking into gaseous components and permit coking to proceed, making it difficult to attain a high gasification rate.

The residence time can be shorter for a starting material being fed to a higher temperature zone. Where starting hydrocarbons are cracked at temperatures over 1,000° C., the time is preferably below 20 milliseconds. Longer reaction times will bring about a lowering in yield of olefins by cracking thereof and a lowering in amount of heat effectively utilized due to the heat loss. On the other hand, the residence time required to thermally crack low boiling hydrocarbons in a downstream zone of the reactor is preferably below 1000 milliseconds. The residence time is determined depending on the reaction type, the pressure, the characteristics of starting materials and the composition of a final product. Residence times longer than 1000 milliseconds will lower a yield of olefins by excessive cracking of once produced olefins.

The reaction pressure is determined in view of the types of starting materials, the reaction conditions, and the conditions of cracked gases being treated in or downstream of the reactor. Higher temperatures result in a larger amounts of acetylene. Formation of acetylene is the endothermic reaction which requires a larger amount of heat than in the case of formation of more useful ethylene, thus bringing about an increase in amount of heat per unit amount of desired ethylenic olefin product. In order to suppress the formation of acetylene, it is necessary to increase the reaction. pressure. However, an increase of the reaction pressure invites an increase of partial pressure of hydrocarbons, thus accelerating coking. In this sense, it is necessary that coking be suppressed while shortening the residence time as well as increasing the reaction pressure. The reaction pressure has relation with treating conditions of cracked gas. When the process of the invention is operated as an ordinary olefin production plant, the pressure of the separation and purification system ranging from 30 to 40 bars should be taken into account. The reaction pressure should be determined in view of the types of starting materials and the cracking conditions. In case where partial combustion is effected in the combustion zone to obtain synthetic gas as well, the reaction pressure should be determined in consideration of applications of the synthetic gas. When the process is operated as the olefin production plant, the pressure is preferably below 50 bars, and in the case where synthetic gas is produced in combination, it is preferable to crack hydrocarbons at a pressure below 100 bars in view of conditions of preparing methanol which is one of main applications of the synthetic gas. If the reaction pressure is below 2 bars, formation of acetylene in the high temperature cracking zone becomes pronounced. Preferably, the pressure is above 2 bars.

The partial pressure of hydrogen has the relation with the suppression in formation of acetylene as described above and the inhibition of coking and is preferred to be over at least 0.1 bar with regard to a partial pressure of hydrogen after cracking of a hydrocarbon comprising hydrocarbon components having boiling points over 200° C. This atmosphere of hydrogen makes it possible to supplement hydrogen which tends to be deficient in the hydrocarbons, to suppress coking, and to attain a high gasification rate. A higher partial pressure of hydrogen is favorable for a heavier hydrocarbon: wit a very heavy hydrocarbon such as vacuum residue, the partial pressure is preferably in the range over 1.5 bars.

Figure 2:
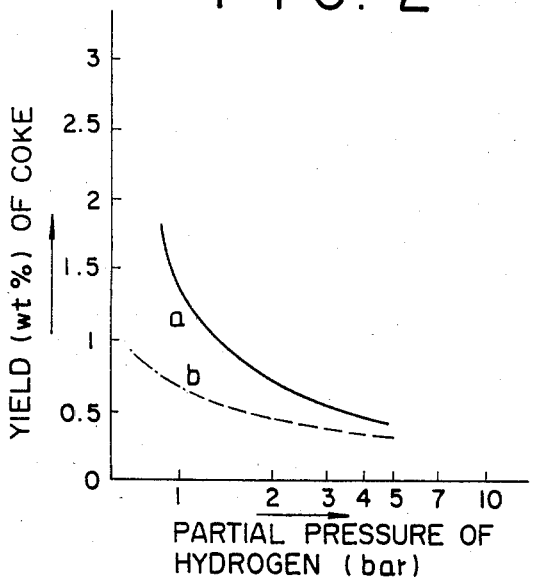
FIG. 2 is a graph showing the relation between yield of coke and partial pressure of hydrogen.

FIG. 2 is a graph showing the relation between partial pressure of hydrogen and yield of coke when a vacuum residue from the Middle East crude oil and naphtha were thermally cracked under conditions of the outlet temperature of a reactor at 1000° to 1020° C., the $CH_4/H_2$ molar ratio at 0.5, the total pressure at 30 bars, and the residence time at 20 milliseconds. The curve a indicates the yield of coke in case where the Middle East vacuum residue was thermally cracked, and the curve b indicates the yield of coke in case where naphtha were thermally cracked. As will be seen from the figure, the heavier hydrocarbon needs a higher partial pressure of hydrogen.

What is claimed is:

1. A thermal cracking process for selectively producing petrochemical products from hydrocarbons which comprises the steps of (a) burning hydrocarbons with oxygen in the presence of steam to produce a hot gas of from 1300° to 3000° C. comprising steam; (b) feeding hydrogen to the hot gas; (c) further feeding starting hydrocarbons, containing hydrocarbons of higher and lower boiling points, to the hot gas comprising the steam and hydrogen such that the starting hydrocarbons are fed to a plurality of different temperature zones of a reactor by a plurality of feed streams so that the feed streams of higher boiling points are fed to a section of the reactor having higher temperature zones, and the feed streams of low boiling range are fed to a corresponding lower temperature zone of the reactor; and thermally cracking the respective hydrocarbons under different conditions while keeping the cracking temperature at 650° to 1500° C., the total residence time at 5 to 1000 milliseconds, the pressure at 2 to 100 bars, and the partial pressure of hydrogen, after thermal cracking of a hydrocarbon comprising hydrocarbon components whose boiling point exceeds 200° C., at at least 0.1 bar; and quenching the resulting reaction product.

2. The thermal cracking process of claim 1 wherein light paraffins produced by the thermal cracking are recycled to a section of the reactor having a lower temperature.

3. The thermal cracking process of claim 1 wherein the cracked oils produced by the thermal cracking are recycled to a section of the reactor having a higher temperature.

4. The thermal cracking process of claim 1 wherein the components produced by the thermal cracking, lighter than cracked oil but heavier than light paraffins, are recycled to the section between the section of the reactor having a lower temperature and the section of the reactor having a higher temperature.

* * * * *